US005271257A

United States Patent [19]

Irwin

[11] Patent Number: 5,271,257

[45] Date of Patent: Dec. 21, 1993

[54] PIPE CRIMPING APPARATUS

[76] Inventor: William J. Irwin, 799 Feeny Road, Dungiven, County Londonderry, BT47 4TA, Northern Ireland

[21] Appl. No.: 920,531

[22] PCT Filed: Jul. 3, 1989

[86] PCT No.: PCT/GB89/00746

§ 371 Date: Mar. 21, 1990

§ 102(e) Date: Mar. 21, 1990

[87] PCT Pub. No.: WO90/00097

PCT Pub. Date: Jan. 11, 1990

Related U.S. Application Data

[63] Continuation of Ser. No. 469,548, Mar. 21, 1990, abandoned.

[30] Foreign Application Priority Data

Jul. 1, 1988 [GB] United Kingdom ..... 8815643

[51] Int. Cl.[5] ..... B21D 41/04

[52] U.S. Cl. ..... 72/316; 72/453.15; 29/237; 29/243.517

[58] Field of Search ..... 72/316, 318, 453.15, 72/453.16, 402; 29/243.517, 282, 283.5, 237

[56] References Cited

U.S. PATENT DOCUMENTS

| | | | |
|---|---|---|---|
| 1,101,434 | 6/1914 | Hatton | 29/243.517 |
| 1,782,219 | 11/1930 | Wallace . | |
| 2,333,120 | 11/1943 | Parker | 29/237 |
| 2,381,748 | 8/1945 | Howe | 29/237 |
| 3,156,284 | 11/1964 | Stanley | 29/282 |
| 3,176,495 | 4/1965 | Zane | 72/402 |
| 3,626,450 | 12/1971 | Browne | 72/402 |
| 4,345,361 | 8/1982 | Baumann | 29/237 |
| 4,835,851 | 6/1989 | Peele | 29/282 |

FOREIGN PATENT DOCUMENTS

| | | | |
|---|---|---|---|
| 142729 | 9/1982 | Japan | 29/237 |
| 21049 | of 1915 | United Kingdom | 29/237 |

*Primary Examiner*—Daniel C. Crane

*Attorney, Agent, or Firm*—Nikaiko, Marmelstein, Murray & Oram

[57] ABSTRACT

A pipe crimping apparatus comprises holding means to externally engage and hold a joint formed by locating one end of a pipe connection onto a pipe end, the holding means having a crimping tool movable relative to the swaged end to cause the swaged end to be deformed and crimped onto the pipe end. In a preferred embodiment, the holding means is elongate and at one end thereof has a gripping zone to engage behind the inner side of a swaged end of the pipe connector, and at the other end thereof the crimping tool is movable longitudinally and internally of the holding means. Means are provided to cause axial movement of the tool towards the gripping zone so to engage the outer side of the swaged end and crimp it to the pipe end.

10 Claims, 3 Drawing Sheets

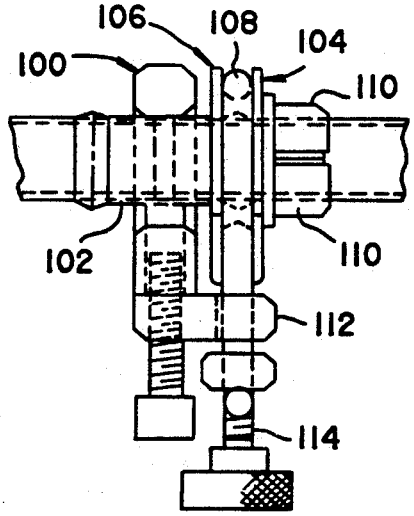
FIG.4
FIG.5
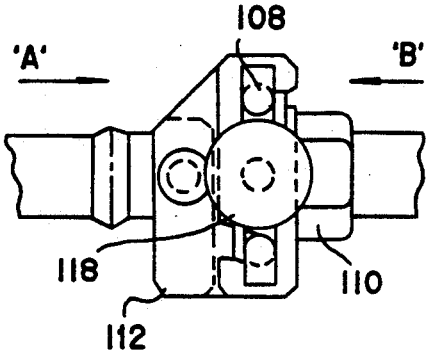
FIG.6A
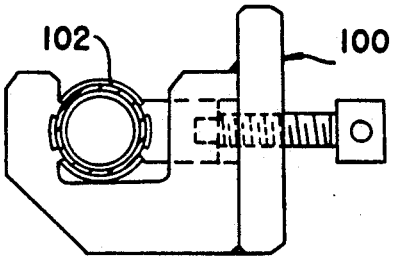
FIG.6B
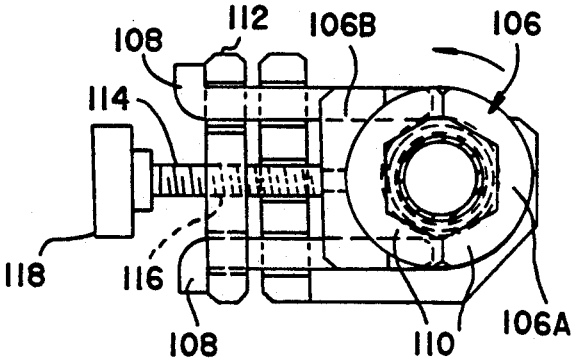
FIG.7
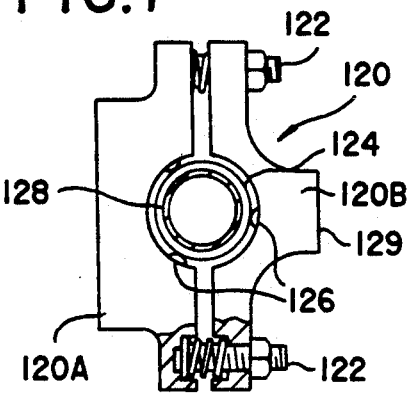
FIG.8
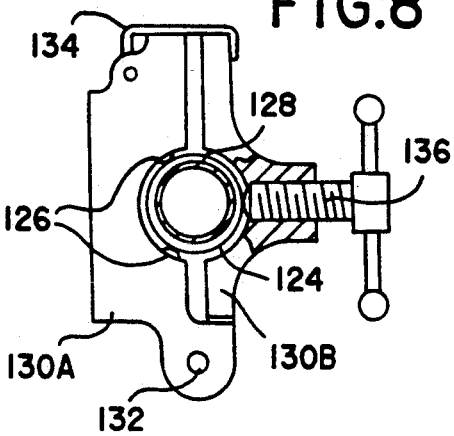

PIPE CRIMPING APPARATUS

This application is a continuation of application Ser. No. 469,548 filed Mar. 21, 1990, now abandoned.

This invention relates to pipe crimping apparatus for crimping the joints of pipe connections of the type having non-flux, non-solder joints such as those described in my co-pending patent application No. GB 8913492 in which pipe ends are provided adjacent to their ends with a collar of increased diameter over which an end of a pipe connector is fitted, said pipe connector end having been swaged to a complimentarily dimensioned diameter to fit over the pipe end, the outer end of said swaged end then being crimped over the side of the collar remote from the end of the pipe. Alternatively, the pipe ends are straight, and pipe connectors are provided in which a collar is pre-fitted into the or each swaged end of each pipe connector, and the swaged end partially crimped around said collar to retain it in position, the swaged end being fully crimped after the swaged end is fitted over one end of a pipe.

The term 'swaged' is used herein to include the increasing in diameter at or adjacent to one or each end of a pipe or pipe connector by mechanical means or by the increase in diameter being formed as part of a casting of the or each end of a pipe or pipe connector.

In accordance with the present invention, a pipe crimping apparatus comprises holding means to externally engage and hold a joint formed by locating one end of a pipe connector onto a pipe end, the holding means having a crimping tool movable relative to the swaged end to cause the swaged end to be deformed and crimped onto the pipe end.

Preferably, the holding means is elongate and at one end thereof has a gripping zone to engage behind the inner side of a swaged end of the pipe connector, and at the other end thereof the crimping tool movable longitudinally towards the gripping zone and internally of the holding means, and means to cause axial movement of the tool towards the gripping zone so to engage the outer side of the swaged end and cause the swaged end to be crimped onto the pipe end. The inward axial movement of the tool preferably causes the inner side of the swaged end to be crimped to the pipe end. Alternatively, the inward movement of the tool preferably causes the outer side of the swaged end to be crimped to the pipe end. Further alternatively, the inward movement of the tool preferably causes the outer side and the inner side of the swaged end to be crimped to the pipe end.

Preferably also, the apparatus is a hand held implement having an elongate handle, at one end of which the elongate means are provided. The elongate means are preferably a pair of jaw members, each being concave and together forming a clamping zone. One or other or both of said members preferably is adapted for movement to an open position to allow the jaw members to be located around a pipe connection then closed to hold same. The crimping tool desirably is in two parts with one for each jaw member. Each part of the tool desirably is an arcuate wall which extends beyond the end remote from the gripping zone.

Preferably also, the means to cause movement of the tool is a lever mounted at the end of the jaw members remote from the gripping zone with one end adapted to engage the projecting ends of the walls. Movement means is desirably provided to cause the lever to urge the walls towards the gripping zone.

Preferably also, one jaw member is stationary with the handle, and the other member is hinged thereto. A bolt arrangement is preferably provided to urge the hinged member into a closed position with the other member. The bolt is preferably securable in said urged position.

Preferably also, the walls are mounted onto their respective members by a fastener and are each provided with a slot about their mounting to allow for restricted lengthwise movement. The projecting end of the walls are each preferably provided with an outward flange to overlie their respective member. The said one end of the lever is preferably bifurcated.

The means to move the lever may be a ram and piston arrangement operated hydraulically, pneumatically or hydro-pneumatically. Alternatively, the lever may be operated by a Bowden cable.

Alternatively, the holding means is a clamp to be secured around the joint with the crimping tool between the clamp and the joint, and means are provided to cause the crimping tool to deform the swaged end. The crimping tool is preferably in two or more pieces assembled around the joint with the holding means retaining the pieces together.

Embodiments of the present invention will now be described, by way of example, with reference to the accompanying drawings, in which:

FIG. 4 is a plan view of an apparatus according to a third embodiment;

FIG. 5 is an end view of the apparatus shown in FIG. 4;

FIGS. 6A and 6B are respectively opposite side views in the direction of arrows 'A' and 'B' shown in FIG. 5;

FIG. 7 is a side view of an apparatus according to a fourth embodiment; and

FIG. 8 is a side view of an apparatus according to a fifth embodiment.

Figure 1:
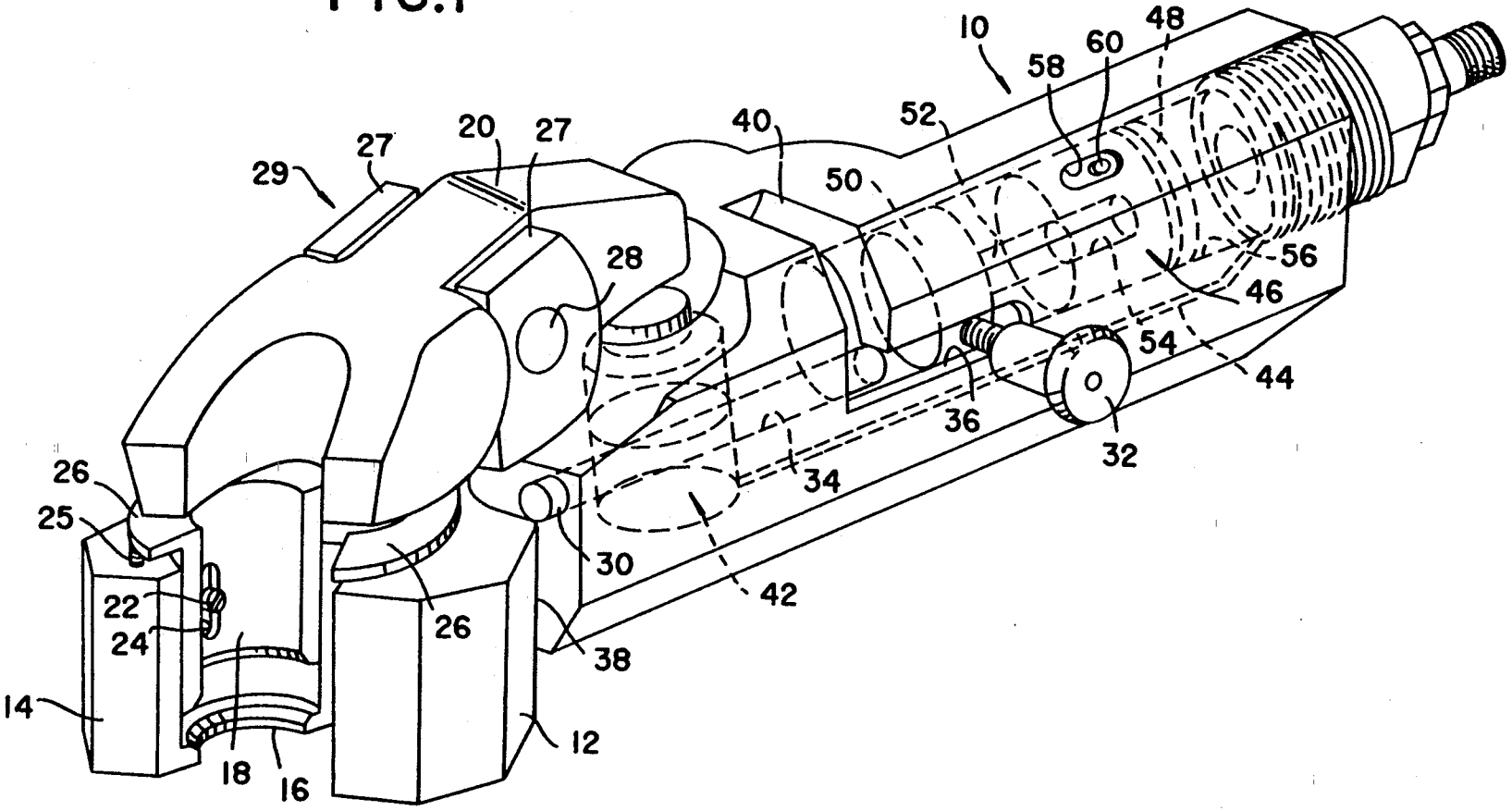
FIG. 1 is a perspective view of a pipe crimping apparatus according to a first embodiment of the present invention.
Figure 2:
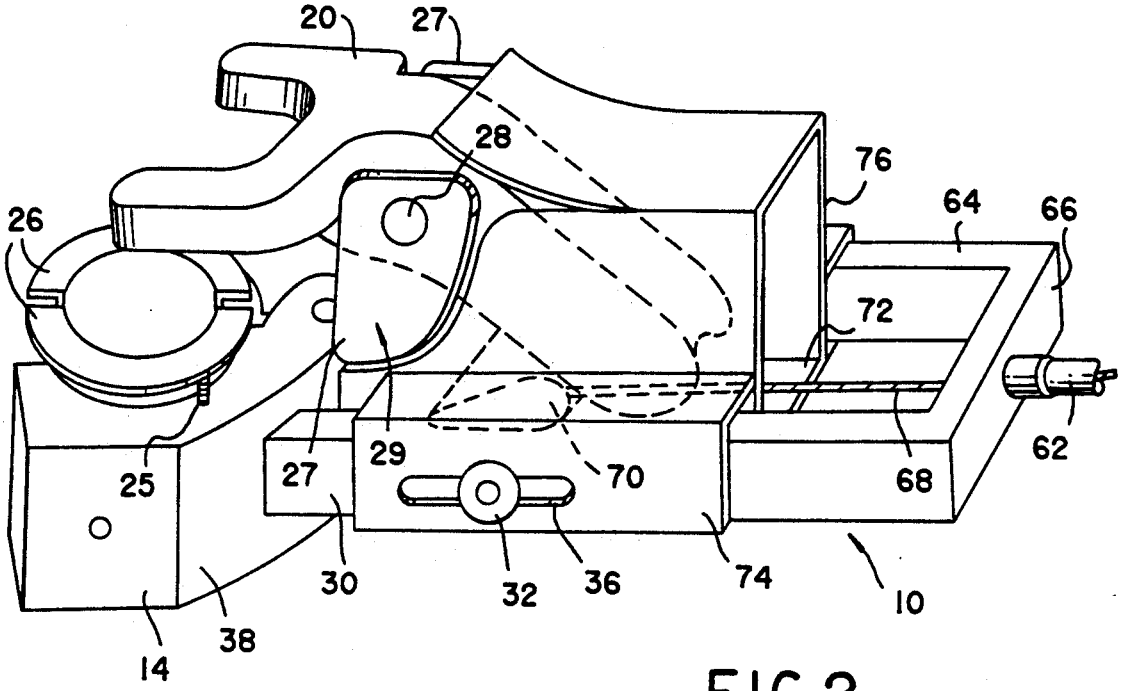
FIG. 2 is a perspective view of the apparatus according to a second embodiment.

Referring to FIGS. 1 and 2 of the drawings, a pipe crimping apparatus according to first and second embodiments generally comprises a hand held implement having an elongate handle 10, at one end of which elongate holding means, in the form of a pair of jaw members 12, 14, are provided with its axis at right angles to the axis of the handle 10. The jaws of both members 12, 14 are similar and concave, and together the concavities of the members form a cylindrical clamping zone with a gripping zone in the form of elements 16 at one end thereof. Jaw member 14 is stationary with the handle 10 and jaw member 12 is hinged thereto to allow the jaw members 12, 14 of the tool to be opened and located around a pipe connection (not shown) and then closed to hold same. The jaw members 12, 14 are spring biased apart to the open positions. A crimping tool is provided at the other end of the jaw members 12, 14 and comprises an inner arcuate wall 18 for each jaw member. The walls 18 extend beyond the end remote from the elements 16 and are movable relative to its member 12, 14 in a direction longitudinal of the clamping zone and adapted for movement towards or away from the gripping elements 16. The walls 18 are each provided with a slot 24 and are mounted onto their respective members 12, 14 by a fastener 22 whose head marginally overlaps the sides of the respective slot 24 to allow for their restricted lengthwise movement. The marginal sides of the respective slot 24 are recessed so that the head of the fastener 22 does not project out beyond the wall's inner face. The projecting end of the walls 18 are each provided with an outward flange 26 to overlie their respective member. Spring biasing, such as in the form of helical springs 25, is provided between the top of the members 12, 14 and their respective flanges 26 and is provided to bias the walls 18 to their outer extent of movement.

As shown in FIG. 1, the gripping elements 16 are contoured to complement the curved shape of the inner side of a swaged end of a pipe connector, and the inner ends of walls 19 are cut away from the inside to outside wall to a thickness the same as, or approximately the same as, the thickness of the swaged end of the pipe connector. The inner walls may be recessed over most of their length to allow the crimping tool to be used with closely adjacent swaged ends, the recessing of the walls allowing a second swaged end to be positioned within the tool but not being acted on by the tool.

Means to cause axial movement of the tool is a lever 20 mounted, to act as a simple lever about fulcrum pivot pin 28, at the end of the jaw members 12, 14 remote from the gripping elements 16 with one end adapted eo engage the flanges 26 of the projecting ends of the walls 18. The pin 28 is provided between two opposed cheeks 27 provided upstanding on a mounting 29 pivotally connected to the handle 10. The said one end of the lever 20 is bifurcated as shown with both arms overhanging said flanges 26. The lever 20 is pivotal to allow it to swivel to fit around a pipe located projecting from the clamping zone.

A bolt arrangement is provided comprising a bolt 30 movable in a bore 34 as shown. The movement of the bolt 30 is controlled by a knob 32 slidable along a slot 36 to urge the bolt 30 against the hinged member into a closed position with the other member. The axes of the slot 36 and bore 34 are parallel to the longitudinal axis of the handle 10. The longitudinal movement of the bolt 30 towards the members 12, 14 causes the outer end of the bolt 30 to abut a cheek 38 on the hinged member 12. The slot 36 has a right-angled extension 40, and the bolt 30 is securable against major axial movement in the handle 10 in said urged position by the knob 32 being moved along said extension 40.

Movement means is provided to cause the lever 20 to urge the walls 18 towards the elements 16 so to crimp an inner side, or an outer side, or both inner and outer sides of a swayed end of a pipe connector to a pipe end when such is located therein.

In the first embodiment, the movement means to move the lever 20 is a first piston and cylinder arrangement 42 operated hydraulically, pneumatically or hydro-pneumatically. The cylinder is a bore provided in the handle 10 adjacent to the members 12, 14 and having an axis at right angles to the handle 10. The piston floats in the cylinder and is movable in response to fluid being fed thereinto through a narrow bore 44 from a supply of fluid fed to the end of the handle 10 remote from the jaw members 12, 14. A second piston and cylinder arrangement 46 is provided as shown and serves, when extended, to urge the bolt 30 into tight abutment with the cheek 38 of member 12 so to retain it in tight abutment with member 12. The cylinder of the arrangement 46 is a bore 56 lengthwise of the handle 10 and the piston of the arrangement 46 is formed in two parts, a first part 48 adjacent to the supply end of the fluid and a second part 50 to which the knob 32 is secured as shown. The first part 48 is secured against rotational movement by a slot 58 being provided in the wall of the bore 56 and a grub screw 60, whose outer end slides in the slot 58, is secured into a tapped bore in part 48. The knob 32 prevents rotational movement of part 50. The two parts are closable together when the knob 32 is in the slot 36. In this position, a spindle 52 projecting towards the first part 48 and provided on an inside face of the second part 50 is in registry with a complementary bore 54 in the first part 48. By moving the knob 32 into the extension 40, the spindle 52, which will have fully emerged from the bore 54, will be out of registry and in front of the inside face of the first part 48. Entry of fluid from the supply, will cause the first part 48 to abut the spindle 52 to cause the second part 50 to urge the bolt 30 tightly against the cheek 38. After the fluid so acts it then flows through bore 44 to the first piston and cylinder arrangement 42. Both pistons of arrangements 42, 46 are spring biased to retracted position by helical spring (not shown) being provided between the end of each cylinder and the leading face of its respective piston.

In use, the implement is hand held and after a pipe connector is located on a pipe end, is used to crimp it, by axial compression against its outer end and behind the inner side of the swaged end, in position in the manner hereinbefore described.

In a modification, the bolt arrangement may be mechanically operated without assistance from the lever movement means.

Figure 3:
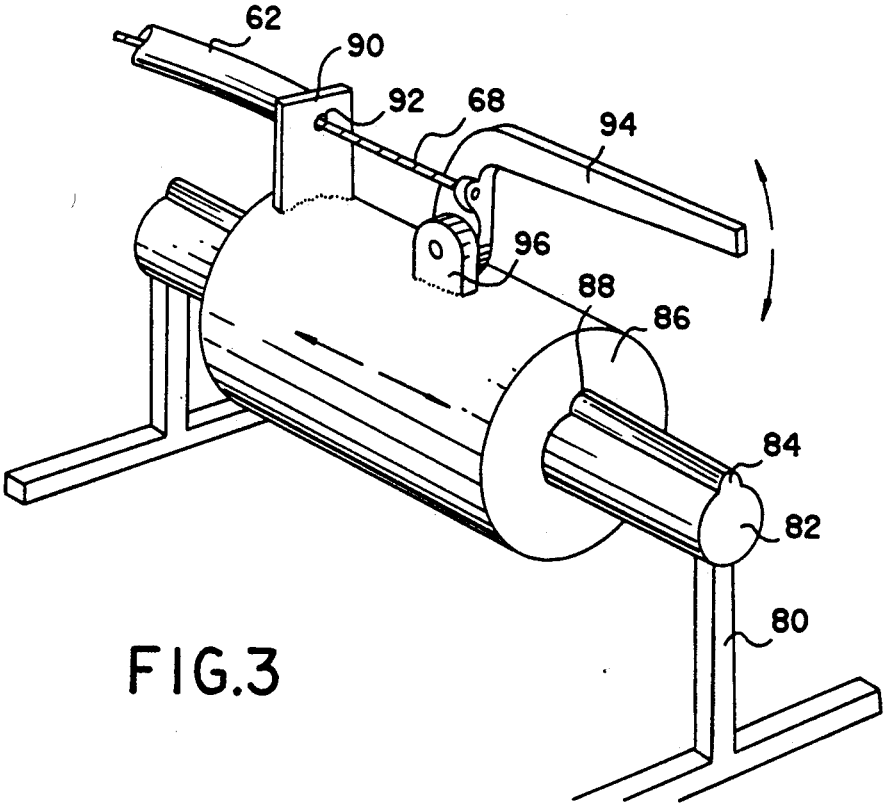
FIG. 3 is a perspective view of a cable operating device for use with the apparatus of the second embodiment.

In the second embodiment as shown in FIGS. 2 and 3, the lever 20 may be operated by a Bowden cable 62, the other end of which is connected to a cable operating device as shown in FIG. 3. In this embodiment, like parts are denoted by like numerals. The slot 36 does not have an extension 40. The handle 10 is of a different construction and appearance. The bolt 30 has a corresponding shaped bar 64 spaced therefrom and parallel thereto as shown and between which at the member remote end, has a transom 66 to which the cable 62 is secured, the core cable 68 passing through a bore in the transom to be secured to a wedge 70 movable along a surface 72, provided in a housing 76, to engage under the end of lever 20 to pivot it about pin 28 to abut the bifurcated end against the flanges 26. The bolt 30 is secured by knob 32 being in the form of a clamping nut in screw threaded engagement with a screw-threaded element secured to bolt 30, the clamping nut being clamped against bolt housing 74. The housing 76 provides spring-biasing to return the lever 20 to its original position and also wedge 70 when the cable 68 is released. The cable operating device (FIG. 3) is a stand 80 having a rod 82 along which a key 84 is provided. A cylinder 86 is low-friction movable lengthwise along said rod 82, the cylinder 86 having a groove 88 to engage said key 84 whereby to prevent the cylinder 86 from rotational movement. The cylinder 86 on its outside surface as shown mounts a plate 90 to which the cable 56 is secured with core cable 68 passing through a hole 92. The core cable 68 is secured to cranked handle 94 pivotally mounted to anchorage 96 secured to cylinder 86 as shown. With the handle 94 in an upward position the wedge 70 is in the position as shown in FIG. 2 and with the handle 94 in the position as shown in FIG. 3 the wedge 70 is pulled to move the lever 20.

In both of the above embodiments, the crimping to the swaged end may alternatively be by spot or dot crimping rather than as above described with the full annular inner, outer or both inner and outer sides of the swaged end being crimped.

In a third embodiment as shown in FIGS. 4, 5, 6A and 6B, the holding means includes a first clamp 100, in the form a 'G' type clamp, to be secured around and hold the pipe connector 102. A second clamp 104 is to be secured around the joint with the crimping tool 106 between the clamp 104 and the joint. The crimping tool 106 is in two or more pieces, two pieces 106A and 106B in this embodiment, assembled around the joint with the second clamp 104 retaining the pieces together. The two pieces are two halves of a pulley wheel, each having a concave crimping configuration on the inside. The pieces each have a lateral extension 110 which together form a hexagonal shape for a purpose to be described hereinafter. The second clamp 104 comprises a 'U' shaped wire clip 108 to fit into the groove of the pulley wheel with the outer ends of the limbs of the clip 108 being splayed apart as shown and engaging through holes in and behind a union plate 112 which serves to join the first clamp 100 and the second clamp 104 together. Means are provided to cause the crimping tool 106 to deform the swaged end, the means comprising a screw threaded spindle 114 in engagement with a tapped bore 116 in the plate 112 and movable towards or away from engagement with the groove of the pulley wheel by rotation of a knob 118 provided at the outer end of the spindle 114.

In use of this embodiment, the first clamp 100 is positioned and clamped to the pipe connector 102. The crimping tool 106 is assembled around the joint and the second clamp 104 is assembled therearound as shown and described above. The knob 118 is turned to urge the inner end of the spindle 114 into the groove. By use of a spanner or the like having a hex opening to fit around the extensions 110, the crimping tool 104 is rotated causing the swaged end to be deformed. On each turn, the knob 118 is tightened so that after several turns, the swaged end is deformed to crimp it onto the pipe end and form a joint.

In the fourth and simplified embodiment as shown in FIG. 7, the holding means is a clamp 120 being in two pieces 120A and 120B secured together by bolts and nuts 122. The crimping tool 124 is in two pieces, one on the inside of each piece 120A and 120B. The tool 120 is shown for use in dot or spot crimping with protrusions 126 shown extending inwardly from the tool to abut the swaged end of the pipe connector 128. The piece 120B of the tool 120 is provided with a flat surface 129 against which the means to cause deformation of the swaged end is urged, the means being a hammer (not shown).

The apparatus of this embodiment is used as described.

In a fifth and simplified embodiment as shown in FIG. 8, the apparatus is similar to that described in the fourth embodiment and like parts will be denoted by like numerals. The holding means is in two pieces 130A and 130B hinged together at 132 and connected together by a clip 134. A spindle 136 is provided to operate in a similar action to spindle 114, the spindle being in screw threaded engagement with a tapped bore in piece 130B. Tightening of spindle 136 causes the tool parts to crimp the swaged end similar to the hammer blow required in the fourth embodiment.

In the third, fourth and fifth embodiments, it will be noted that radial compression is used instead of axial compression as used in the first and second embodiments.

Variations and modifications of the means for causing the crimping tool to move relative to the gripping zone of the elongate means can be made without departing from the scope of the invention as described above.

I claim:

1. A pipe crimping apparatus comprising:

holding means to externally engage and hold a joint to be formed by swaging one end of a pipe connector onto a pipe end, the holding means being elongate and formed by two jaw members each having an inner concavity together defining a substantially cylindrical clamping zone for clamping said pipe;

a crimping tool movable relative to the clamping zone;

movement means to cause movement of the crimping tool relative to the clamping zone, wherein (a) the jaw members are pivotally related with a gripping zone provided at one end of the holding means and formed with an internal peripheral element which is configured to grip said pipe connector, the jaw members further provided with means for selectively, relatively moving said jaw members into a closed position with said joint, (b) the tool is substantially cylindrical extending axially into the clamping zone to be urged towards the gripping zone on axial actuation of the movement means and formed in two parts corresponding to the jaw members with each part secured to its respective jaw member for restricted lengthwise movement relative thereto, each part of the tool being an arcuate wall which projects beyond the other end of the holding means and being spring-biased to an outer position, and wherein (c) the movement means includes a lever mounted at an outer end of the arcuate walls with one end of the lever being bifurcated and adapted to engage the projecting ends of the walls to cause movement of the walls towards the internal peripheral element.

2. Apparatus according to claim 1, wherein the projecting ends of the walls are each provided with an outward flange to overlie their respective jaw members, the distance of the flanges from their respective jaw members determining the extent of lengthwise movement.

3. Apparatus according to claim 1, wherein the lever is pivotally mounted for swivel movement.

4. Apparatus according to claim 1, 2 or 3, wherein the movement means is a ram and piston arrangement operated by at least one of hydraulics, pneumatics and hydro-pneumatics.

5. Apparatus according to claim 1, wherein the apparatus is a hand held implement having an elongate handle at one end of which the holding means are provided.

6. Apparatus according to claim 5, wherein one jaw member is stationary with the handle and the other member is hinged thereto.

7. Apparatus according to claim 6, wherein the jaw members are spring-biased apart.

8. Apparatus according to claim 7, wherein a bolt arrangement is provided to urge the hinged member into said closed position with the other jaw member against the biasing.

9. Apparatus according to claim 8, wherein the bolt is securable in said urged position.

10. Apparatus according to claim 1, 2 or 3, wherein the means to move the lever is a Bowden Cable.

* * * * *